US008028504B2

(12) United States Patent
Zeller et al.

(10) Patent No.: US 8,028,504 B2
(45) Date of Patent: Oct. 4, 2011

(54) PACKAGING MACHINE

(75) Inventors: Hubert Zeller, Ottobeuren (DE); Dieter Holzem, Erolzheim (DE)

(73) Assignee: Multivac Sepp Haggenmuller GmbH & Co. KG (DE)

( * ) Notice: Subject to any disclaimer, the term of this patent is extended or adjusted under 35 U.S.C. 154(b) by 114 days.

(21) Appl. No.: 12/386,494

(22) Filed: Apr. 17, 2009

(65) Prior Publication Data

US 2009/0266028 A1 Oct. 29, 2009

(30) Foreign Application Priority Data

Apr. 18, 2008 (DE) ..... 10 2008 019 628

(51) Int. Cl.
*B65B 47/00* (2006.01)

(52) U.S. Cl. ..... 53/559; 53/561; 53/453

(58) Field of Classification Search ..... 53/559, 53/561, 560, 453, 454; 100/918, 35, 215, 100/224

See application file for complete search history.

(56) References Cited

U.S. PATENT DOCUMENTS

| | | | | | |
|---|---|---|---|---|---|
| 3,871,611 | A | * | 3/1975 | Taketa | 249/102 |
| 4,013,392 | A | * | 3/1977 | Smith | 425/157 |
| 4,056,207 | A | * | 11/1977 | Spilker | 414/620 |
| 4,202,522 | A | * | 5/1980 | Hanas et al. | 249/102 |
| 4,472,127 | A | | 9/1984 | Cyriax et al. | |
| 4,614,108 | A | * | 9/1986 | Bolle et al. | 72/446 |
| 5,014,500 | A | * | 5/1991 | Robache | 53/559 |
| 5,040,404 | A | * | 8/1991 | Henderson et al. | 72/446 |
| 5,074,143 | A | * | 12/1991 | Nolan et al. | 72/446 |
| 5,113,960 | A | * | 5/1992 | Prinz | 180/65.51 |
| 5,307,610 | A | * | 5/1994 | Schneider et al. | 53/559 |
| 5,619,913 | A | * | 4/1997 | Padovani | 100/35 |
| 5,755,653 | A | * | 5/1998 | Nishida | 483/1 |
| 5,940,953 | A | | 8/1999 | Arends et al. | |
| 6,240,706 | B1 | * | 6/2001 | Thomas et al. | 53/329.3 |
| 6,543,983 | B1 | * | 4/2003 | Felder et al. | 414/402 |
| 7,340,871 | B1 | * | 3/2008 | Shackelford et al. | 53/453 |
| 2006/0160684 | A1 | | 7/2006 | Springston et al. | |

FOREIGN PATENT DOCUMENTS

| | | |
|---|---|---|
| DE | 38 01 032 | 7/1989 |
| DE | 38 01 032 A1 | 7/1989 |
| EP | 1 234 765 A1 | 8/2002 |
| EP | 1 598 275 | 11/2005 |
| EP | 1 234 765 | 5/2006 |
| JP | 57 34915 A | 2/1982 |

OTHER PUBLICATIONS

European Search Report—Application No. 09158069.6-2308, Applicant: Multivac Sepp Haggenmuller GmbH & Co KG, Dated Aug. 11, 2009-5 Pages.

* cited by examiner

*Primary Examiner* — Sameh H. Tawfik
(74) *Attorney, Agent, or Firm* — Brooks Kushman P.C.

(57) ABSTRACT

Changing or feeding, respectively, of a working tool (11) into a workstation (110) of a packaging machine (1) takes place by varying a distance of a receiving unit having arranged the working tools (11), with respect to a support rack (15) by means of a lifting device (200). By means of a shifting means (300) the working tool (11) can be shifted from the support (10) into the workstation (110), or reverse. Therein, the support (10) can be formed such that it is movable out of the packaging machine (1).

18 Claims, 3 Drawing Sheets

PACKAGING MACHINE

TECHNICAL FIELD

The invention concerns a packaging machine for packaging of products.

BACKGROUND

Packaging machines for packaging of products generally comprise several workstations. In particular, packaging machines often comprise a deep drawing station and a sealing station downstream of the deep drawing station as workstation. In the deep drawing station, product receiving portions are formed in a lower film passing through the packaging machine, in which the products to be packed are inserted in a step succeeding the deep drawing station, by means of a working tool. Subsequent to the insertion of the products to be packed into the product receiving portions, the latter are sealed in the sealing station with an upper film also passing through the packaging machine. Depending on the size of the products to be packed, the size of the product receiving portions also has to be varied. Thus, depending on the size of the products to be packed, different working tools have to be used. In this process, the working tools should be replaceable preferably simple and without damaging the film.

From the publication EP 1 234 765 E1 a packaging machine is known, in which a working tool can be transferred from a resting position via a hand-over-place into a workstation, and reverse. As the transfer of the working tool takes place underneath or above the respective film, respectively, changing of the working tool can take place without damaging the film.

Due to the stepwise delivery of the working tool leaving the resting position to the hand-over place and to the working position, the time required for the delivery of the working tool to the work station and thus for the entire packaging process increases. Furthermore, resulting from the individual stations the working tool has to pass, the composition of the packaging machine is rather complex.

SUMMARY

The object underlying the present invention is to provide a packaging machine in which the packaging process is more efficient and in which the packaging machine is constructed in a more simple manner.

In particular, the advantages achieved by the invention reside in that the construction of the packaging machine is simplified, by directly shifting the working tool from one support to the workstation and no hand-over place provided in between is present anymore. Due to the direct shifting of the working tool to the workstation the time required for the packaging process is also shortened.

A further advantage of the invention is that the support is moveable out of the packaging machine, whereby the working tools are accessible more easily, for instance to be cleaned more easily.

A further advantageous development of the invention is that a position of the receiving unit, in which the working tools are arranged, can be adjusted by means of a lifting device, and thus the desired working tool can be selected from a plurality of working tools. It is also an advantage that additionally changing of the working tool from the workstation takes place more efficiently by adjusting the position of the receiving unit by means of the lifting device such that a working tool is moved into an empty receiving region located in the receiving unit. Thus, an intermediate deposition of the working tools onto a hand-over place is not required.

Further, another development of the invention is that the admissible size for the working tool to be used and thus the size of the product receiving portion is increased by arranging one working tool on each side of a rotatable plate arranged at the support.

A further advantageous development of the invention is that the working tool in the work station is firmly coupled to a bottom plate. Therewith the working accuracy of the working tool increases.

Details of the invention will be explained based on the below drawings.

BRIEF DESCRIPTION OF THE DRAWINGS

FIG. 1 shows a perspective view of a packaging machine 1 and a support 10 outside the packaging machine 1.

DETAILED DESCRIPTION

Figure 1:
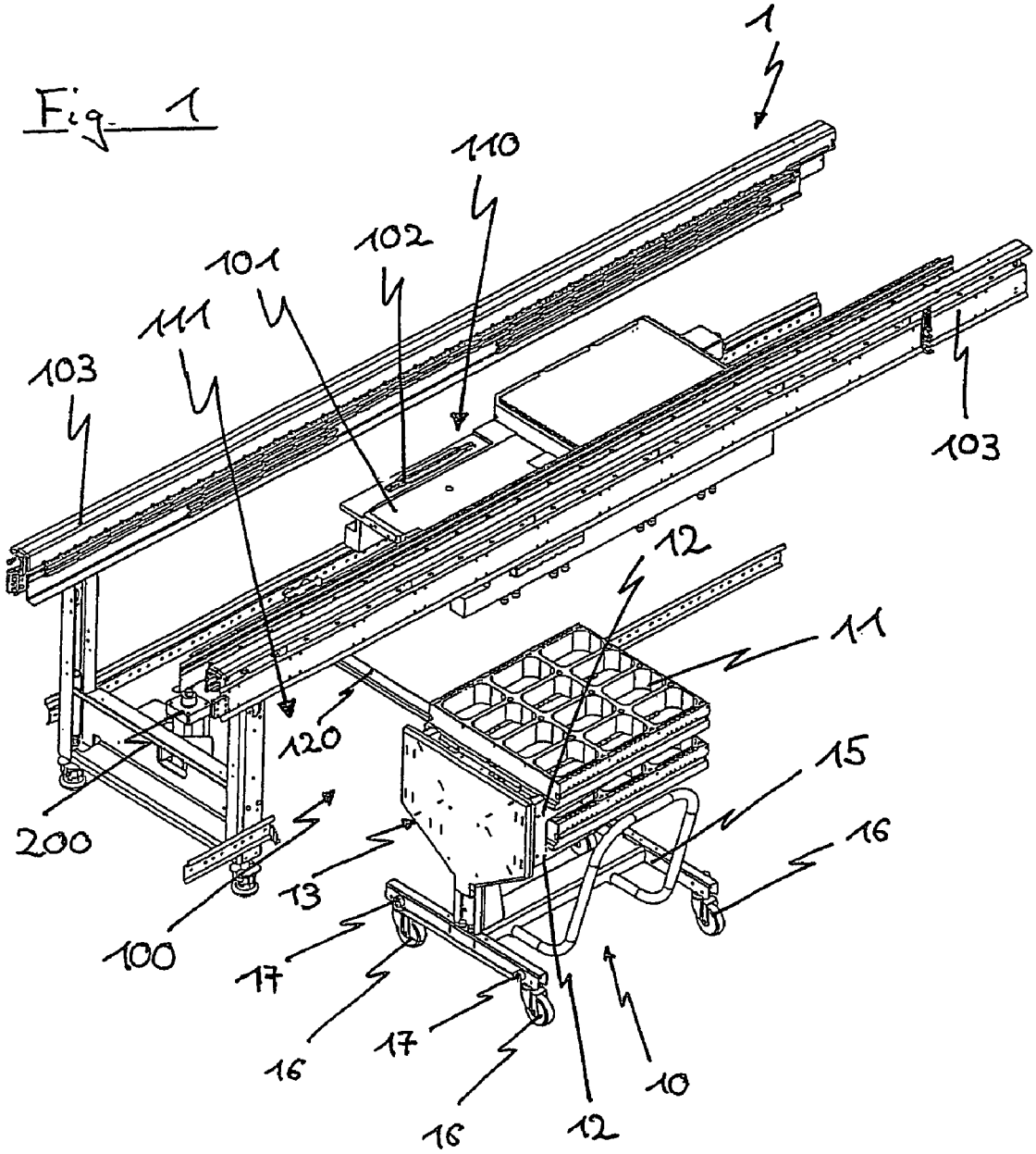
FIG. 1: a perspective view of a packaging machine with a support being located outside the packaging machine.

The support 10 comprises a support rack 15 and a receiving unit 13 arranged on the support rack 15, for receiving working tools 11. Rollers 16 are arranged at the support rack 15, which enable moving the support 10. Further, the support rack 15 comprises first guiding elements 17, by means of which the movement of the support 10 in the packaging machine 1 is guided.

The working tools 11 are held each in a respective receiving region arranged in the receiving unit 13, by a support, which, for instance, is formed as supporting rails 12. The individual receiving regions are arranged perpendicularly to the driving direction of the support 10 on top of each other. Further, the receiving unit 13 is arranged at the support rack 15 such that the receiving unit 13 is shiftable perpendicularly to the driving direction of the support 10. This shifting of the receiving unit 13 is, for example, enabled by means of a linear guide attached to the support rack 15.

As an alternative to the support, a support (not shown) for transporting of working tools into the packaging machine can be used. This support is composed of the support rack and a rotatable plate arranged at the support rack. At least one working tool is arranged on each of opposite sides of the plate. Therein, the plate is rotatable around a rotation axis preferably mounted in the middle of the plate.

The packaging machine 1 comprises two opposite rails 103 in which means for transporting of an upper film and/or lower film, not shown in FIG. 1, are situated. The packaging machine 1 also comprises a bottom plate 101 arranged in a working station 110, which, for example, can be formed as a deep drawing station, wherein lifting rails 102 are arranged at the bottom plate 101, by means of which the working tool 11, shifted out of the support 10, is guided on and attached to the bottom plate 101. As soon as the working tool 11 is attached by means of the lifting rails 102, forming of product receiving portions in a lower film by means of the attached working tool 11 can take place.

Further, the packaging machine 1 comprises a space portion 111 adjacent to the workstation 110, into which the support 10 is drivable for changing and/or feeding of a working tool 11. The space portion 111 adjacent to the workstation 110 is limited by two guiding elements 120 parallel to the driving direction of the support 10, and a bar 121 extending transversally with respect to the second guiding elements 120. Further, the space portion 111 is limited in the direction perpendicular to the driving direction of the support 10 by the lower film not shown in FIG. 1. The packaging machine 1 comprises an opening 100 of the space portion 111 pointing in direction of the support 10, through which the support 10 can be driven into the space portion 111. This opening 100 is a limitation for the geometry of the support 10, as the latter has to be formed such that also the working tool situated furthest away from the support rack 15 fits through the opening 100, as, otherwise, the support 10 cannot be driven into the packaging machine 1. Thus, the number and/or the size of the receiving regions are limited by the geometry of the packaging machine 1, especially by the opening 100.

During a movement of the support 10 into the packaging machine 1, the driving direction of the support 10 is determined by the first guiding elements 17 arranged at the support rack 15, which are guided by the second guiding elements 120 attached to the packaging machine 1 during driving of the support into the packaging machine 1. The possible movement path of the support 10 in driving direction of the support 10 is limited by the bar 121 extending transversally with respect to the second guiding elements 120. A movement of the support 10 out of the packaging machine 1 can, for example, be prevented by means of fixing means or specific forming of the second guiding elements 120.

In this case, the first guiding elements 17 arranged at the support 10 are guiding rollers and the second guiding elements 120 attached to the packaging machine 1 are guiding rails. Other first and second guiding elements attached to the support 10 and/or the packaging machine 1 can be imagined, which guide a movement of the support 10 in the packaging machine 1.

Further, the packaging machine 1 comprises a lifting device 200, preferably formed as a pneumatic cylinder, by means of which a selection of the receiving region of the receiving unit is enabled. By means of the lifting device 200, the receiving region together with the selected working tool 11 is shifted relative to the supporting rack 15, until the supporting rails of the selected receiving region are arranged relative to the bottom plate 101 such that a shifting of the working tool 11 from the support 10 to the bottom station 110 is ensured. During shifting of the working tool 11 from the working station 110 into an empty receiving region of the receiving unit 13 analogously, as described above, the receiving unit 13 is shifted by means of the lifting device 200, until the shifting of a working tool 11 from the working station 110 into the empty receiving region of the support 10 is ensured. In both cases the shifting of the working tool 11 takes place by means of a shifting means 300.

Thereby, it is also ensured that the support 10 is formed such that in the maximum deflection of the lifting device 200, and thus at the maximum distance of the receiving region, situated furthest away from the support rack 15, the working tool 11 held in this receiving region cannot contact and thus damage the lower film arranged in or between the rails 103, respectively.

Figure 2:
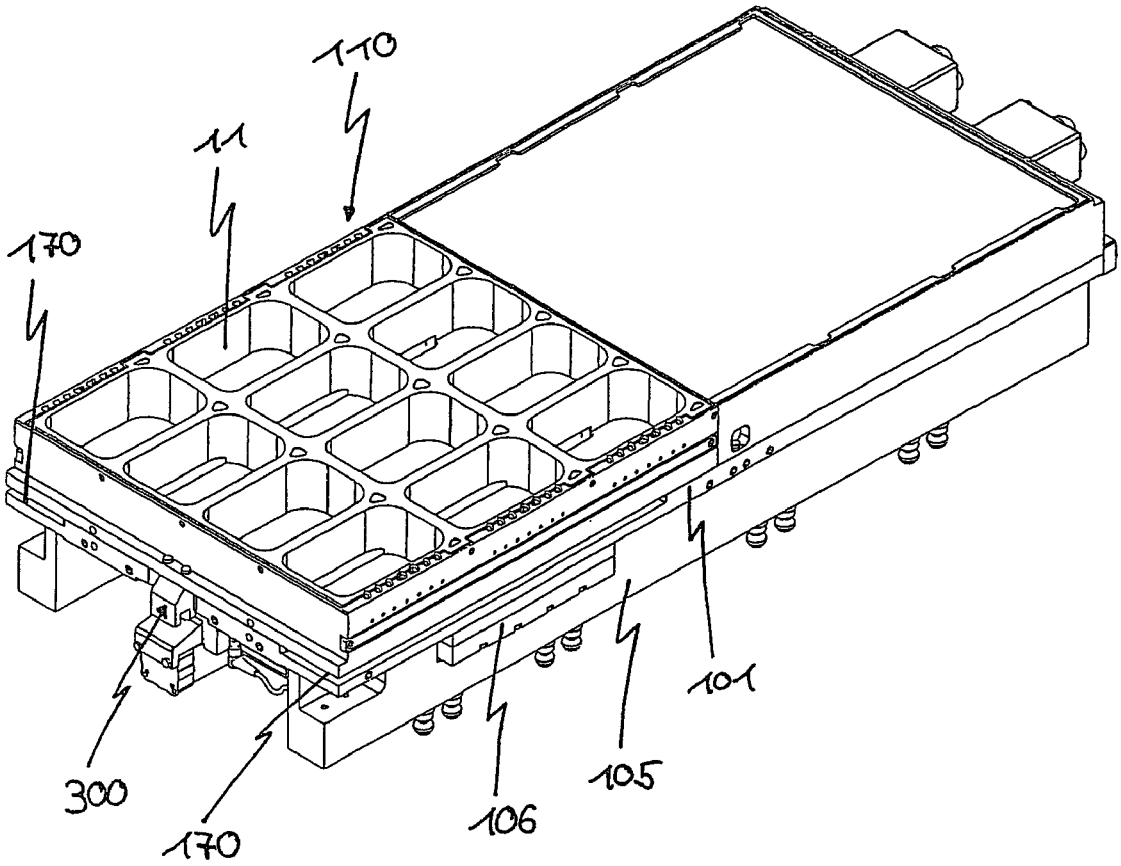
FIG. 2: a perspective view of a working tool arranged in a workstation.

FIG. 2 shows a perspective view of a working tool 11 arranged on the workstation 110. The workstation 110, in addition to the bottom plate 101, also comprises a connecting frame 105 on which the bottom plate 101 is arranged. The connecting frame 105 further comprises a device for raising the lifting rails 106, which is coupled to the lifting rail 102, not visible in FIG. 2. This device for raising the lifting rails 106 provides means causing a lifting movement of the device for raising the lifting rails 106 and thus of the lifting rail 102.

Figure 3:
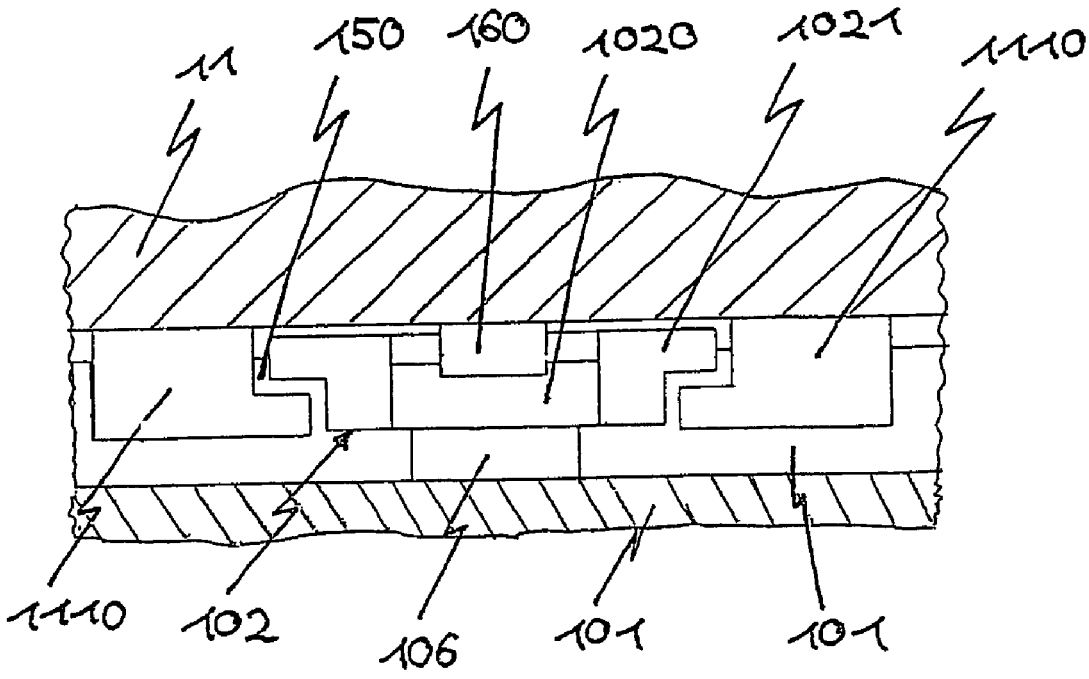
FIG. 3: a partial sectional view through the working tool, the bottom plate, and a lifting rail.

At its surface sides opposite to the bottom plate 101, the working tool 11 comprises edges 1110, shown in FIG. 3, each being situated in one first space 170 appearing between the bottom plate 101 and the working tool 11, wherein these edges 1110 comprise a smaller length or height, respectively, than the first space 170. Further, between these edges 1110 a second space 150 (FIG. 3) is formed. Therein, this second space 150 is formed such that in a configuration of the working tool 11 on the workstation 110 in each case it is engaged by the lifting rails 102 arranged on the bottom plate 101.

Further, in the workstation 110, underneath a bottom plate 101, the extensible shifting means 300 is arranged. The shifting means 300 therein comprises a coupling unit (not shown) on one end, which is coupled to the working tool 11 in an extended state of the shifting means 300, thus enabling the shifting of the working tool 11.

FIG. 3 shows a partial section view through the working tool 11, the bottom plate 101, and the lifting rail 102. Therein, FIG. 3 shows an unattached state of the working tool 11 at the bottom plate 101.

The lifting rail 102 is arranged in the second space 150 formed between the edges 1110 and comprises a rectangular region 1020 with a recess, wherein the rectangular region 1020 is in contact with the device for raising the lifting rails 106 at one side. Further, the lifting rail 102 comprises an L-shaped region 1021 at the sides arranged perpendicularly to the bottom plate 101. On the side of the lifting rail 102 facing away from the bottom plate 101, a slide element 160 is arranged in the recess of the rectangular region 1020 of the lifting rail 102. Further, the slide element 160 is in contact with the working tool 11 at the side facing away from the recess. The second space 150 formed between the edges 1110 therein is formed such that during the attachment of the working tool 11 at the bottom plate 101 the L-shaped region of the lifting rail 102 is coupled with the respective edge 1110.

During attachment of the working tool 11 on the bottom plate 101, a force pointing in direction of the bottom plate 101 is exerted on the lifting rail 102 by means of the device for raising the lifting rails 106, because of which the lifting rail 102 moves into this direction. Due to the movement of the lifting rail 102 in the direction towards the bottom plate 101, the force directed in the direction towards the bottom plate 101 is transmitted via the L-shaped region 1021 of the lifting rail 102 to the respective edge 1110 and thus to the working tool 11, by which the working tool 11 also moves in the direction towards the bottom plate 101 and thus is fixed to the bottom plate 101.

Instead of the plurality of receiving regions in the receiving unit 13 arranged in the support 10, also two supports 10 can be provided with only one receiving unit each, wherein in the receiving unit of the first support 10 a working tool 11 is carried and the receiving unit of the second support 10 is empty. Thus, changeover of the working tools 11 by means of the two supports can take place without shifting of the receiving unit 13 and the lifting device 200 can be abandoned.

Further, the workstation is not limited to forming stations, but can also be used with other workstations as for example sealing and/or cutting stations.

What is claimed is:

1. A packaging machine for use with a film, the packaging machine comprising:

a movable support including a receiving unit;

at least one working tool arrangeable on the receiving unit;

a workstation, onto or from which the at least one working tool can be shifted;

a space portion adjacent the working station for receiving the support;

a shifting means for shifting the at least one working tool to or from the support; and a lifting device configured to contact the receiving unit when the support is received in the space portion of the packaging machine;

wherein the shifting of the at least one working tool takes place in a contact free manner with respect to the film and the support is movable out of the space portion of the packaging machine.

2. The packaging machine according to claim 1, wherein the at least one working tool comprises a plurality of working tools, and the receiving unit has a plurality of receiving regions arranged on top of each other, and wherein each of the plurality of working tools is arrangeable in a respective receiving region.

3. The packaging machine according to claim 2 wherein the shifting means is configured to shift the working tools independently of each other to or from the support.

4. The packaging machine according to claim 1, wherein the a lifting device is essentially on the same level as the support.

5. The packaging machine according to claim 1, wherein the receiving unit comprises a receiving region for receiving the at least one working tool, and a support member for carrying the at least one working tool in the receiving region.

6. The packaging machine according to claim 1, further comprising first and second guiding elements for guiding the support into the space portion of the packaging machine.

7. The packaging machine according to claim 1, further comprising a bottom plate and a lifting rail on the bottom plate, the lifting rail being engageable with the at least one working tool for fixing the at least one working tool in the workstation.

8. The packaging machine according to claim 7, wherein each of the at least one working tool comprises multiple edges with a space between the edges, and the edges are engageable with the lifting rail.

9. The packaging machine according to claim 1, wherein the shifting means comprises an end and a coupling unit on the end, wherein the at least one working tool is engageable with the coupling unit.

10. A packaging machine according to claim 1, wherein the workstation comprises a deep drawing station.

11. The packing machine of claim 1 wherein the support comprises a support portion that supports the receiving unit, and the lifting device is operable to lift the receiving unit with respect to the support portion when the support is received in the space portion.

12. The packaging machine of claim 1 wherein the at least one working tool is configured to form product receiving portions in the film, and the space portion is arranged beneath the film when the film is received in the packaging machine.

13. The packaging machine of claim 12 wherein the support is movable in a first direction into the space portion of the packaging machine, and the shifting means is operable to shift the at least one working tool in a direction transverse to the first direction between the workstation and the support when the support is disposed in the space portion.

14. The packaging machine of claim 1 further comprising first and second rails positioned above the workstation and the space portion for receiving the film.

15. The packaging machine according to claim 1 wherein the at least one working tool comprises multiple working tools, the receiving unit has multiple spaced apart receiving regions arranged one on top of another, and each of the working tools is arrangeable in a particular receiving region, and wherein the lifting device is operable to adjust position of the receiving unit when the support is received in the space portion to align a respective receiving region with the workstation, so that the shifting means may shift a respective one of the working tools to or from the respective receiving region.

16. The packaging machine according to claim 15 wherein the receiving unit further comprises multiple support members for supporting the working tools in a spaced apart manner in the receiving regions.

17. A packaging machine for use with a film, the packaging machine comprising:

a movable support including a receiving unit having multiple spaced apart receiving regions arranged one on top of another;

multiple working tools that are each arrangeable in one of the receiving regions of the support;

a workstation onto or from which each of the working tools can be shifted;

a space portion adjacent the working station for receiving the support;

a shifting device for shifting each of the working tools to or from the support when the support is received in the space portion; and a lifting device for adjusting vertical position of the receiving unit when the support is received in the space portion to align a respective receiving region with the workstation;

wherein the space portion is arranged beneath the film when the film is received in the packaging machine, the shifting device is operable to shift a respective one of the working tools to or from the respective receiving region in a contact free manner with respect to the film when the respective receiving region is aligned with the workstation, and the support is movable out of the space portion.

18. The packaging machine of claim 17 wherein the support is movable in a first direction into the space portion of the packaging machine, and the shifting device is operable to shift each of the working tools in a direction transverse to the first direction between the workstation and the support when the support is disposed in the space portion.

* * * * *